US005086849A

United States Patent [19]

Dahl

[11] Patent Number: 5,086,849

[45] Date of Patent: Feb. 11, 1992

[54] APPARATUS USEFUL IN DRIVING ELECTRICAL GROUND RODS

[76] Inventor: Robert R. Dahl, Rte. 1, Box 45, Walkerville, Mich. 49459

[21] Appl. No.: 699,367

[22] Filed: May 13, 1991

[51] Int. Cl.[5] ..... E02D 7/04

[52] U.S. Cl. ..... 173/126; 173/90; 173/115

[58] Field of Search ..... 173/126, 90, 18, 128, 173/129, 115, 131

[56] References Cited

U.S. PATENT DOCUMENTS

| | | | |
|---|---|---|---|
| 2,690,055 | 12/1954 | Lundgren et al. | 173/126 |
| 2,693,086 | 11/1954 | Caruthers et al. . | |
| 2,802,340 | 8/1957 | Tallman . | |
| 2,998,087 | 8/1961 | Iddings | 173/126 |
| 3,073,571 | 1/1963 | Wunsch . | |
| 3,115,199 | 12/1963 | Linabery | 173/126 |
| 3,499,497 | 3/1970 | Moore . | |
| 3,712,389 | 1/1973 | Smoak | 173/126 |
| 3,735,822 | 5/1973 | Deike | 173/118 |
| 3,827,509 | 8/1974 | Larson | 173/128 |
| 4,448,264 | 5/1984 | Peyton | 173/152 |
| 4,557,409 | 12/1985 | Hecock et al. | 227/147 |
| 4,971,479 | 11/1990 | Byers, Sr. et al. | 405/232 |

*Primary Examiner*—Frank T. Yost
*Assistant Examiner*—John M. Husar
*Attorney, Agent, or Firm*—Robert K. Wallor

[57] ABSTRACT

Three tubular elements are rigidly bundled together so as to have, in use, a common upper end elevation. The first element is closed at its upper end by a rigid cap element and depnds from the common upper end by approximately 30 centimeters (approximately two feet). The second element consists of a substantially identical length of tube, open at its upper end, depending to a plug element closing its lower end, from which another identical length of tube coaxially depends to an open lower end at about 62 centimeters (marginally greater than four feet) below the upper end. The third element depends from the common upper end through a distance preferred to be between one hundred fifty two centimeters and one hundred eighty three centimeters (between approximately five and six feet), for use as a handle. Included is an extension element, formed of a length of solid rod, of the same diameter as a ground rod an marginally longer than the upper tubular segment of the second element, to which a short segment of the same tubular stock is coaxially rigidly affixed. Alternate embodiments and uses are described.

8 Claims, 2 Drawing Sheets

APPARATUS USEFUL IN DRIVING ELECTRICAL GROUND RODS

BACKGROUND OF THE INVENTION

1. Field of the Invention

This invention relates generally to electrical ground rod driving devices, and more specifically to apparatus of improved construction so as to be capable of performing its intended use with a user thereof standing, at all times during said use, at local earth level adjacent said electrical ground rod, said apparatus being further intended to drive said electrical ground rod completely into the earth without resort to the use of sledges or hammers.

2. Description of the Prior Art

Ground rods for electrical service are usually required by construction codes and accepted practice to be at least ten feet (greater than 3.0 meters) in length, and driven substantially vertically into the earth for their entire length. It has often, heretofore, been common practice to provide a laborer with a ladder and a sledge hammer, the laborer ascending the ladder to a height sufficient to enable striking the top end of a vertically held electrical ground rod with the sledge hammer, the laborer descending the ladder appropriately as the electrical ground rod is driven into the earth so as to readily repeat striking the top end of the electrical ground rod with the sledge hammer. This approach, while usually employed for its simplicity and minimal tool requirements, is accompanied by significant risks in that the ladder may become unstable from variations in terrain level and softness of the earth. Also, it often arises that the sledge does not squarely strike the top end of the electrical ground rod, producing strain on the laborer to retain control of the sledge hammer during such glancing blows. Moreover, it is not unusual for the sledge hammer to be dropped during such a glancing blow, creating a hazard to other persons proximate to the situs of the electrical ground rod.

Several inventions are present in the prior art which provide apparatus useful in assisting in driving posts and rods. Such devices range from simple manually operable weights vertically drivable onto attachments coupled to the posts or rods, to adaptations of devices commonly known as pile drivers. As examples of simple mechanical devices, reference is made to U.S. Pat. Nos. 2,690,055; 2,693,086; 2,802,340, 2,998,087; 3,115,199; 4,448,264; and 4,971,479. More complex devices are illustrated by U.S. Pat. Nos. 3,073,571; 3,499,497; and 3,827,509.

In U.S. Pat. No. 2,690,055, issued 09/28/54 to LUNDGREN, et.al. for "Post Driving Device," an annular cylindrical element, having most of its mass at a lower end, is placed around the post. Using the external handles provided, the element is manually vertically raised and then brought forcefully downwardly against a bracket relocatably affixed to the post being driven. In U.S. Pat. No. 2,693,086, issued 11/02/54 to CARUTHERS, et.al. for "Ground Rod Driver," an elongated hollow tube is configured to fit around the rod. A lower weighted end of the rod slides over a threaded collet type attachment relocatably coupled to the ground rod. The tube impacts vertically downwardly upon a shoulder of the collet under manual manipulation of the elongated tube. The patent to TALLMAN, issued as U.S. Pat. No. 2,802,340 on 08/13/57 for "Ground Rod Driver," is almost identical to the device of CARUTHERS, et.al., with TALLMAN being one of the co-inventors of the earlier patent. U.S. Pat. No. 2,998,087, issued 08/29/61 to IDDINGS for "Fence Post Driver," also uses an elongated tube, this tube having a weighted closure at its upper end, which is manually vertically drawn downwardly so that the weight strikes the upper end of the post being driven. Earlike handles are provided for ease of use of this device.

In U.S. Pat. No. 3,115,199, issued 12/24/63 to LINABERY for "Post Driving Device," a short section of tubing, having a weighted plug at an upper end thereof, is provide with extended downwardly directed handles to enable manually drawing the tube downwardly onto the top of the post being driven. The extent of the handles allows the user to stand on the ground surface while using this device. However, the length of the handles appears to limit the depth to which the upper end of the rod may be driven. Another elongated tube device is described in U.S. Pat. No. 4,448,264, issued 05/15/84 to PEYTON for "Ground Rod Driving Pole." This device includes a number of spring-loaded pins passing transversely through the tube, each generally horizontally, in a spaced apart arrangement longitudinally along the extent of the tube. The pins are first retracted to ride along an exterior surface of a ground rod inserted into the tube, except for the uppermost pin. As the tube is manually raised and lowered, the upper transverse pin strikes the upper end of the ground rod until the raising of the tube between downward strokes enables the next lower transverse pin to pass over the upper end of the ground rod, this pin then becoming the driving impact pin. Each such transverse pin sequentially is allowed to pass over the top end of the ground rod.

For posts having pre-formed transverse holes, a relocatable bracket engaging a selected hole through the post is taught by BYERS, Sr., et.al. in U.S. Pat. No. 4,971,479, issued 11/20/90 for "Post Driver," to serve as an impact surface for an annular weight element drawn downwardly thereon. The weight may be placed below the bracket, before attachment of the bracket, to assist in removing the post.

A small version of a hydraulic pile driver is described in U.S. Pat. No. 3,073,571, issued 01/15/63 to WUNSCH for "Tractor Mounted Metal Post Driver." Pneumatic Jack hammers engage with brackets affixed to poles in both U.S. Pat. No. 3,499,497, issued 03/10/70 to MOORE for "Sign Pole Driver," and U.S. Pat. No. 3,827,509, issued 08/06/74 to LARSON for "Floating Type Drive Spike Accessory."

SUMMARY OF THE INVENTION

Accordingly, an object of the present invention is to provide an apparatus adapted to enable a user, standing on the earth surface adjacent a site at which an extended electrical ground rod is to be driven, to manually drive the electrical ground rod substantially vertically into the earth.

Another object of the present invention is to provide an apparatus adapted to manually accomplish driving an electrical ground rod substantially vertically into the earth wherein separate driving segments are arranged so that handling of the apparatus substantially proximate to a center of gravity thereof is facilitated.

An additional object of the present invention is to provide an apparatus adapted to accept an extension element useful in accomplishing a final stage of driving an electrical ground rod so that an uppermost end of the electrical ground rod is substantially at earth level of the surrounding earth surface.

A further object of the present invention is to provide an apparatus that is of durable construction and that is inexpensive to fabricate.

These, and other objects, advantages, and features of the present invention that may become apparent through the subsequent description and claims herein, are provided by an apparatus comprising three unequal length tubular elements and an extension element. A first tubular element, having a relatively short length, of the order of about two feet (approximately 0.6 meter), is rigidly enclosed at an upper end by a cap of a high tensile strength material, and is open at a lower end thereof. A second tubular element, having an overall length of approximately four feet (approximately 1.2 meters), is adapted to be open at both an upper and a lower end, with a plug of a high tensile strength material rigidly affixed therewithin at substantially a mid-point of its longitudinal extent. A third tubular element, having an extent of approximately five feet (approximately 1.8 meters), is open at each end thereof, and contains no internal plugs. Each of the three tubular elements is provided with an inner diameter suitable to freely and slidably accept an outer diameter of the electrical ground rod therewithin.

The apparatus of the present invention is fabricated such that when the upper ends of the first, the second, and the third tubular elements are at the same vertical elevation, and when the three tubular elements are arranged to have their longitudinal axes intersect a transverse plane at the apexes of an equilateral triangle having side lengths substantially equal to an outer diameter of each tubular element, said tubular elements are rigidly mutually coupled together along their respective mutual lengths, such as by a welding process. Accordingly, the lower ends of the three tubular elements will assume differing elevations.

An extension element is formed of a short length of tubular structure substantially identical to said three tubular elements rigidly coupled, at a first end thereof, to a cylindrical rod portion having an outer diameter substantially identical with that of an electrical ground rod and a length of approximately twenty-five inches (approximately 0.64 meters). The end of the tubular portion opposite to the end to which the rod portion is affixed remains open. The tubular portion and the rod portion of the extension element are joined such that their respective longitudinal axes are coaxial.

In use, the assembly of the three tubular elements provides the driving apparatus for vertically embedding all but about two feet of the electrical ground rod. Initially, an upper end of the electrical ground rod is inserted into the open end of the shortest of the three tubular elements of the apparatus. The electrical ground rod and the apparatus are then manually positioned to a vertical attitude with the lower end of the electrical ground rod placed at the desired point of entry into the earth surface. Using the longest of the three tubular elements as a handle, a user of the apparatus raises the apparatus relative to the electrical ground rod through a distance less than the length of the shortest tubular element and then brings the apparatus forcefully downwardly so that the cap on the end of the shortest tubular element strikes upon the upper end of the electrical ground rod, causing the electrical ground rod to be driven downwardly into the earth. Repeated vertical motions of the apparatus are then performed by the user until the lower end of the longest tubular element approaches the earth surface.

At such time, the apparatus is raised sufficiently so that the shortest tubular element is fully above the upper end of the partially driven electrical ground rod. Further vertical elevation of the apparatus is then performed such that the lower end of the intermediate length tubular element is at an elevation greater than the upper end of the partially driven electrical ground rod. The open lower end of the intermediate length tubular element is engaged over the upper end of the electrical ground rod. Again using the longest tubular element as a handle, the electrical ground rod may then be driven further by repeated vertical strokes causing the plug within the second tubular element, proximate to its longitudinal mid-point, to impact on the upper end of the electrical ground rod, driving it farther into the earth.

When further driving using the lower portion of the second tubular element would cause the lower end of the third tubular element to contact the local earth surface, the apparatus is again elevated so that the lower end of the second tubular element is at an elevation above that of the upper end of the partially driven electrical ground rod, disengaging the second tubular element from the electrical ground rod. The apparatus is then inverted and the open end of the initially upper portion of the second tubular element, now oriented to be the lower portion thereof, is engaged over the upper end of the electrical ground rod. Repeated vertical striking of the plug affixed within the second tubular element on the upper end of the electrical ground rod will cause the electrical ground rod to be driven until only about two feet (about 0.6 meters) thereof remain above the local earth surface.

Subsequently, the apparatus is again raised to disengage from the upper end of the electrical ground rod. The tubular portion of the extension element is then placed on the upper end of the electrical ground rod and the inverted lower portion of the second tubular element (initially the upper portion of the second tubular element) is placed over the rod portion of the extension element. It is to be noted that the rod portion of the extension element is longer than the length of the portion of the second tubular element into which it slides. Thus, repeated vertical manipulation of the apparatus will cause the plug within the second tubular element to strike the upper end of the rod portion of the extension element without contact between the end of the second tubular element and the tubular portion of the extension element. The lower end of the rod portion of the extension element, at the interface with the tubular portion of the extension element, impacts on the upper end of the electrical ground rod. Vertical manipulation of the apparatus is continued until the tubular portion of the extension element becomes embedded in the local earth surface, at which time the full length of the electrical ground rod has been driven substantially vertically into the earth.

It is clear that the above described embodiment may be varied and/or modified, both as to lengths of the several tubular elements, and as to their mutual arrangement, without departing from the spirit of the present invention. All such obvious variations are contemplated to be within the scope of the present invention as characterized by the claims appended hereto.

BRIEF DESCRIPTION OF THE DRAWING

In the accompanying drawing, wherein like reference numbers and symbols are utilized throughout to refer to like elements and features.

DETAILED DESCRIPTION OF THE PREFERRED EMBODIMENT

Figure 1:
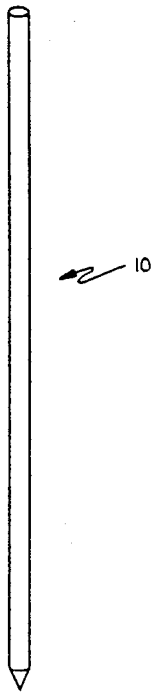
FIGURE 1 (PRIOR ART)
FIG. 1 illustrates a typical electrical ground rod as suggested by the prior art.

Referring first to FIG. 1, a typical electrical ground rod, as suggested by the prior art, is indicated generally at 10. In practice, the electrical ground rod 10 is generally configured as a substantially right circular cylindrical solid having a length of at least ten feet (in excess of 3.0 meters) and a diameter commensurate with providing adequate structural strength to enable said electrical ground rod to be driven longitudinally vertically into the earth for its entire length. Such electrical ground rods are formed from a material exhibiting a high degree of electrical conductivity, with copper being an example of a material of choice.

Figure 2:
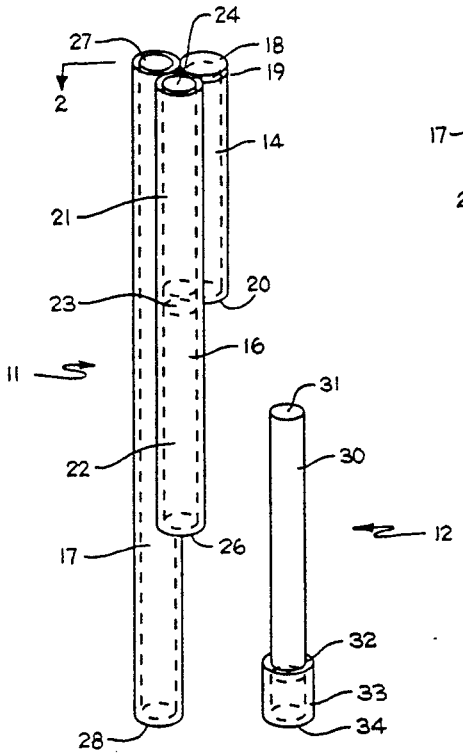
FIG. 2 presents a perspective view of an apparatus in accordance with the present invention.

Referring next to FIG. 2, in accordance with the present invention, an apparatus for manually driving an electrical ground rod into the earth is indicated generally at 11, with an extension element thereof indicated generally at 12. The apparatus 11 is formed as a rigid assembly of a first tubular element 14, a second tubular element 16, and a third tubular element 17. Each of the tubular elements 14, 16, and 17 are formed of right circular cylindrical stock to be of identical respective inner diameters, each accepting the outer diameter of said electrical ground rod 10 longitudinally therein, with sufficient margin to enable freely longitudinally sliding the electrical ground rod 10 therein in an axial direction of said tubular elements 14, 16, or 17. The three tubular elements 14, 16, and 17 also have respectively equal annular wall thicknesses and outer diameters. As can be noted from the illustration of FIG. 2, the first tubular element 14 has the shortest length, the third tubular element 17 has the greatest length, and the second tubular element 16 has a length intermediate thereof.

While exact lengths of the three tubular elements 14, 16, and 17 are not crucial to the construction or use of the apparatus 11, as a practical matter, the first tubular element 14 should be provided with a length of substantially twenty-four inches (approximately 61 centimeters). A cap element 18, formed of a high tensile strength material, is rigidly affixed to an upper end 19 of the first tubular element 14 to enclose said upper end 19 while providing a right circular cylindrical coaxial cavity, of the aforesaid approximate length, within the annular walls of said first tubular element 14. A lower end 20 of said first tubular element 14 is to be open.

Construction of said second tubular element 16 is accomplished by rigidly assembling two segments 21 and 22 of said tubular stock, each having a length of substantially twenty-four inches (approximately 61 centimeters), with an intermediate plug element 23 so as to form an extended tubular element 16 having a length exceeding four feet (exceeding 122 centimeters) by the thickness of the plug element 23. The second tubular element 16 is therefore open at both an upper end 24 and a lower end 26 thereof, with coaxial right circular cylindical cavities extending downwardly from said upper end 24 and upwardly from said lower end 26, respectively, within said segments 21 and 22, each cavity having an internal axial length of the aforesaid approximate segment length.

Said third tubular element 17 is formed from a single segment of said tubular stock to have a length of substantially five feet (approximately 152.4 centimeters), open at both an upper end 27 thereof and at a lower end 28 thereof, with no intermediate plug elements or blockage. Any other convenient length, sufficient to enable a user to conveniently grasp and support said third tubular element 17 in a raised vertical orientation such that said upper end 27 is at least ten feet (at least in excess of 3.0 meters) above the local earth surface, may be employed. However, a length in excess of six feet (in excess of 183.0 centimeters) is to be avoided as creating difficulty in use, as will become evident from a description of use of the apparatus 11 given later herein. The third tubular element 17 may also, in an alternate embodiment be formed of a solid cylindrical stock in lieu of the preferred annular cylindrical stock.

Figure 3:
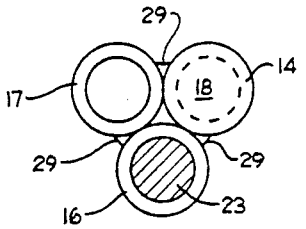
FIG. 3 is a top view of a portion of the apparatus of FIG. 2, taken from a plane indicated by 3—3 of FIG. 2.

Referring next to FIG. 3, showing an end view of the assembly of the apparatus 11 taken from the top of said apparatus 11, together with FIG. 2, the apparatus 11 may be observed to be an assembly of said first tubular element 14, said second tubular element 16, and said third tubular element 17. This assembly is accomplished by arranging the longitudinal axes of the three tubular elements 14, 16, and 17 to respectively orthogonally intersect an imaginary plane so as to be at the vertices of an equilateral triangle, with respective outer wall surfaces of the tubular elements in appropriate mutual contact. In such an arrangement, the exposed planar surface of the cap element 18 rigidly coupled to the upper end 19 of the first tubular element 14, the upper end 24 of the second tubular element 16, and the upper end 27 of the third tubular element 17 are to be disposed to be substantially coplanar. Rigidity of the assembly of the apparatus 11 is provided by rigidly coupling abutting longitudinal extents of the three tubular elements 14, 16, and 17 to each other, such as by longitudinally extending weld beads 29.

Referring again to FIG. 2, the extension element 12 is formed of a segment 30 of right circular cylindrical solid stock, having an upper end 31 thereof and a lower end 32 thereof. The segment 30 is, in the preferred embodiment, configured to have a diameter substantially equivalent to the diameter of the electrical ground rod 10 of FIG. 1, so that said segment 30 may be freely inserted axially into said cavities of the tubular elements of the apparatus 11, as will be described in subsequent discussions of the use of the present invention. A short tubular segment 33, formed from the same tubular stock as the three tubular elements 14, 16, and 17, is rigidly affixed to said lower end 32 of the segment 30 so as to be substantially coaxially aligned therewith. A lower end 34 of the short tubular segment 33 remains open to form an internal cylindrical cavity.

While precise lengths of the segment 30 and the tubular segment 33 forming the extension element 12 are left to user driven selection, as a practical matter, the length of the tubular segment 33 should be sufficient to enable engaging the extension element 12 onto the upper end of the electrical ground rod 10 while maintaining approximate coaxial alignment therebetween. Typically, a length of between three inches (approximately 7.6 centimeters) and six inches (approximately 15 centimeters) is preferred. As for the solid segment 30, its length is preferred to be approximately twenty-five inches (approximately 63.5 centimeters) so that the upper end 31 of the segment 30 will contact the high tensile strength plug intermediate within said second tubular element 16, when said segment 30 is axially inserted into either open cavity of said second tubular element 16, without permitting the corresponding end of said second tubular element 16 to come into contact with said tubular segment 33 of said extension element 11.

Figure 4:
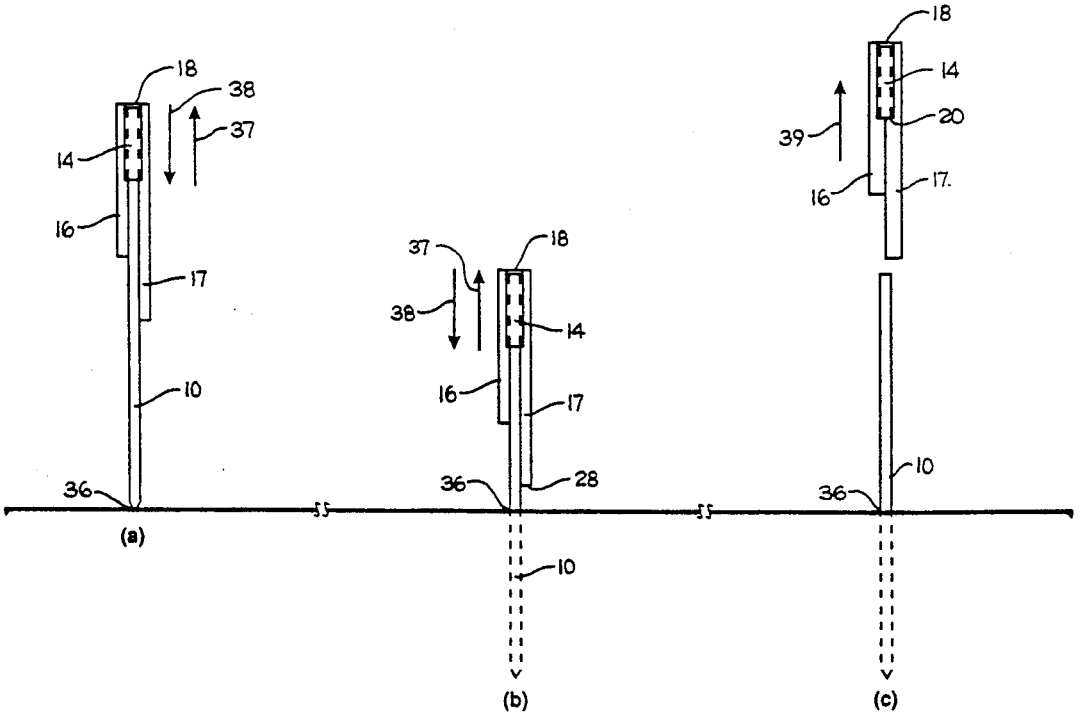
FIG. 4 provides a sequential illustration of a first stage of use of the apparatus in accordance with the present invention, with FIG. 4*a* showing an initial positioning of an electrical ground rod and the present apparatus, FIG. 4*b* showing the electrical ground rod driven substantially to the extent allowable during said first stage of use, and FIG. 4*c* showing removal of said apparatus upon completion of said first stage of use.

Referring next to FIG. 4, a first stage of use of the present invention is illustrated. Initially, as shown in FIG. 4*a*, the apparatus 11 is mated to an upper end of an electrical ground rod 10 such that an upper portion of said electrical ground rod 10 is axially inserted into the cylindrical cavity of the first tubular element 14. The combination of the apparatus 11 and the electrical ground rod 10 is then oriented so that the lower end of the electrical ground rod 10 is in contact with the surface of the earth at a desired point of entry 36, with the electrical ground rod 10 being held in a substantially vertical attitude. In this orientation, a user, standing proximately adjacent the desired point of entry 36, grasping the third tubular element 17 as a handle and raising, in a direction indicated by an arrow 37, the apparatus 11 vertically through a distance less than that enabling the apparatus 11 to become disengaged from the upper end of the electrical ground rod 10 and then forcefully drawing the apparatus vertically downwardly, in a direction indicated by an arrow 38, so that the cap element 18 rigidly affixed to the upper end 19 of the first tubular element 14 impacts on the upper end of the electrical ground rod 10, a downwardly directed force is imparted onto the upper end of the electrical ground rod 10, causing the lower end of the electrical ground rod 10 to be partially driven into the earth. Repeatedly raising and forcefully lowering the apparatus 11 onto the upper end of the electrical ground rod 10, respectively in the directions indicated by the arrows 37 and 38, will cause the electrical ground rod 10 to be driven substantially vertically into the earth through a portion of its longitudinal extent to a position approaching that shown by FIG. 4*b*. It is to be noted that the user should frequently reposition the point of grasping along the extent of the third tubular element 17 to avoid disengaging the first tubular element 14 from the upper end of the electrical ground rod 10.

When the lower end 28 of the third tubular element 17 approaches the local earth surface, the first stage of use of the present invention is concluded. The apparatus 11 is then disengaged from the electrical ground rod 10 by grasping the third tubular element 17 such that the apparatus 11 may be vertically raised, in a direction indicated by an arrow 39, until the lower end 20 of the first tubular element 17 is substantially higher than the upper end of the electrical ground rod 10, as shown in FIG. 4*c*.

Figure 5:
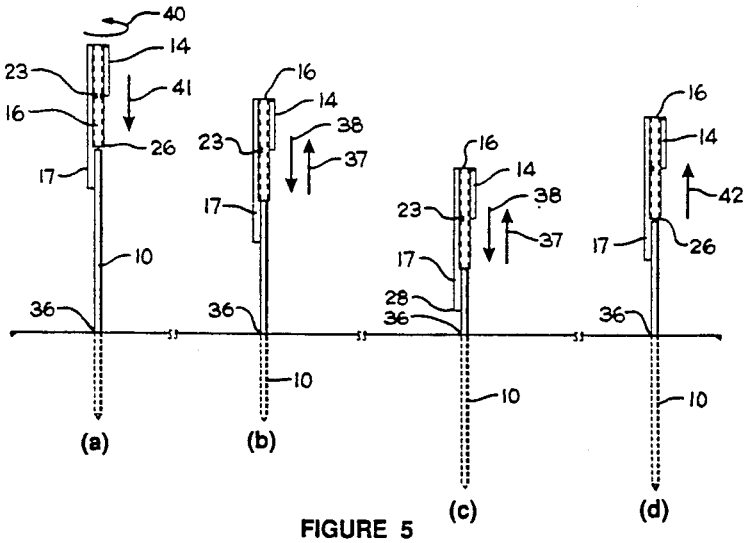
FIG. 5 provides a sequential illustration of a second stage of use of the apparatus in accordance with the present invention, with FIG. 5*a* showing the orientation of said apparatus in preparation for the start of said second stage of use, FIG. 5*b* showing an initial portion of driving during said second stage of use, FIG. 5*c* showing the electrical ground rod driven substantially to the extent allowable during said second stage of use, and FIG. 5*d* showing removal of said apparatus upon completion of said second stage of use.

Referring next to FIG. 5, illustrating a second stage of use of the present invention, the vertical raising of the apparatus 11 suggested by FIG. 4*c* is continued, as shown in FIG. 5*a*, through a distance sufficient such that the lower end 26 of the second tubular element 16 is at an elevation greater than the upper end of the electrical ground rod 10. The apparatus 11 is then rotated, as indicated by an arrow 40, about a centroid of the imaginary equilateral triangle of the three tubular elements 14, 16, and 17, shown in FIG. 3, and in the plane thereof, until the cavity within said second tubular element 16, extending upwardly from its lower end 26, is aligned with the upper end of the electrical ground rod 10. The apparatus 11 is then lowered, in a direction indicated by an arrow 41, so that an upper portion of the extent of the electrical ground rod 10 is axially inserted into the lower cavity of the second tubular element 16 and the intermediate plug 23 rests upon the upper end of the electrical ground rod 10, as shown in FIG. 5*b*.

Appropriately regrasping the third tubular element 17 as a handle, the user then raises the apparatus 11, in the direction indicated by the arrow 37, through a distance less than that enabling disengagement of the lower segment 22 of the second tubular element 16 from the upper end of the electrical ground rod 10, and then forcefully downwardly draws the apparatus 11, in the direction indicated by the arrow 38, so as to cause the plug 23 to impact upon the upper end of the electrical ground rod 10, causing the electrical ground rod 10 to be further driven substantially vertically into the earth. Raising and forcefully lowering the apparatus, respectively in the directions indicated by the arrows 37 and 38, regrasping the third tubular element 16 as necessary, enables the user to drive the electrical ground rod 10 into the earth to an extent suggested by FIG. 5*c*.

When the lower end 28 of the third tubular element 17 approaches interferring proximity to the local earth surface, in its lowered position, the second stage of use of the present invention is concluded. The apparatus 11 is then disengaged from the upper end of the electrical ground rod 10, as shown in FIG. 5*d*, by vertically raising it, in a direction indicated by an arrow 42 through a distance sufficient to bring the lower end 26 of the second tubular element 16 to an elevation greater than the then driven elevation of the upper end of the electrical ground rod 10.

Figure 6:
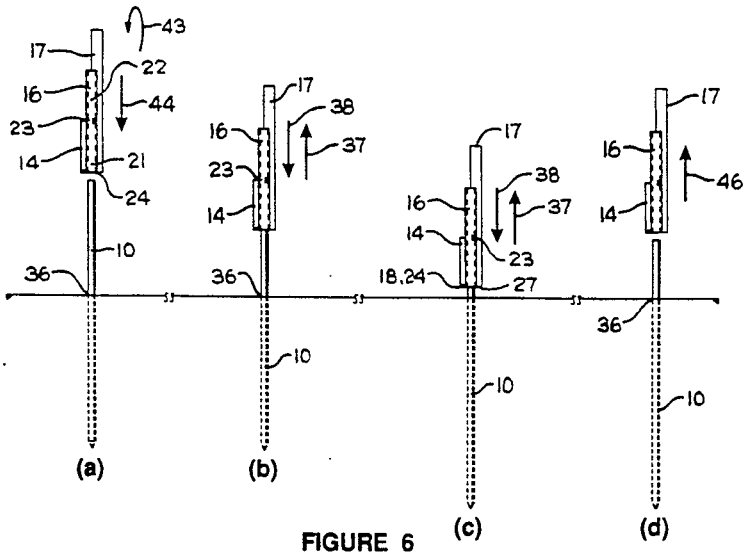
FIG. 6 provides a sequential illustration of a third stage of use of the apparatus in accordance with the present invention, with FIG. 6*a* showing the orientation of said apparatus in preparation for the start of said third stage of use, FIG. 6*b* showing an initial portion of driving during said third stage of use, FIG. 6*c* showing the electrical ground rod driven substantially to the extent allowable during said third stage of use, and FIG. 6*d* showing removal of said apparatus upon completion of said third stage of use.

Referring next to FIG. 6, illustrating a third stage of use of the present invention, the apparatus 11, elevated as suggested in FIG. 5*d*, is first rotated end for end in a vertical plane about an axis perpendicular to the longitudinal extent of the apparatus 11, as indicated by an arrow 43 in FIG. 5*d* and in FIG. 6*a*, such that the erstwhile upper segment 21 of the second tubular element 16 assumes an orientation wherein its internal cavity, extending from the original upper end 24 to the plug 23 is vertically aligned over the upper end of the electrical ground rod 10, the open end 24 being at a present lowermost position as shown in FIG. 6*a*. The apparatus 11 is then vertically lowered, in a direction indicated by an arrow 44, until the upper end of the electrical ground rod 10 is axially inserted into the cavity of the second tubular element 16 at the end 24, with the plug 23 resting upon the uppermost end of the electrical ground rod 10, as shown in FIG. 6*b*. Again, the user, regrasping the third tubular element 17 as a handle as may be necessary, continues driving the electrical ground rod 10 vertically into the earth by raising and forcefully lowering the apparatus 11 so as to cause the plug 23 to impact upon the upper end of the electrical ground rod 10. These repeated actions, respectively in the directions indicated by the arrows 37 and 38, cause driving of the electrical ground rod 10 from the position suggested by FIG. 6*b* to the position suggested by FIG. 6*c*, which also represents an approximate end position for the third stage of use of the present invention. Upon reaching the position suggested by FIG. 6*c*, whereat the initially upper ends 18, 24, and 27 of the first tubular element 14, the second tubular element 16, and the third tubular element 17, respectively, now oriented to be the lower end of the apparatus 11, approach contact with the local earth surface, the apparatus 11 is disengaged from the electrical ground rod 10 by raising the apparatus 11, in a direction indicated by an arrow 46, until the end 24 of the second tubular element 16 is at an elevation greater than the upper end of the electrical ground rod 10. The apparatus 11 is then temporarily set aside in preparation for the final stage of use of the present invention.

Figure 7:
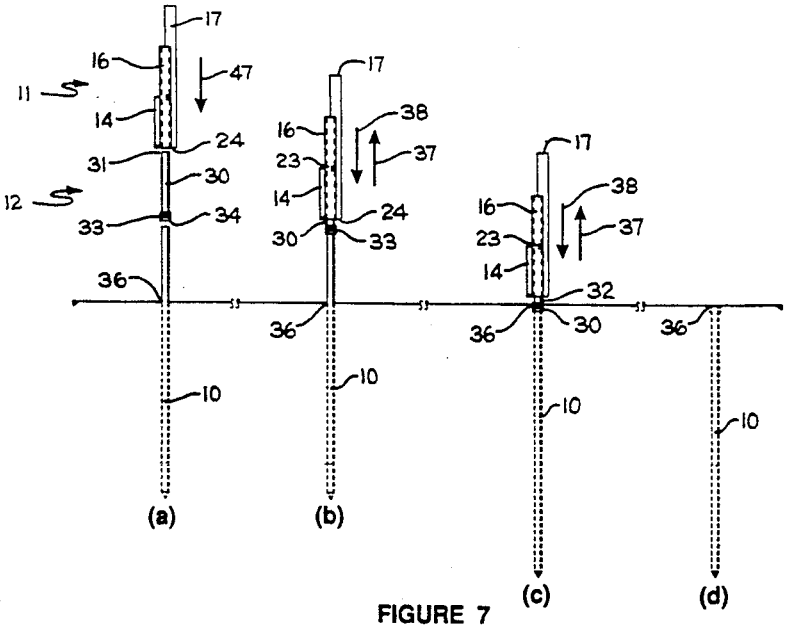
FIG. 7 provides a sequential illustration of a final stage of use of the apparatus in accordance with the present invention, with FIG. 7*a* showing the orientation of said apparatus, including an extension element thereof, in preparation for the start of said final stage of use, FIG. 7*b* showing an initial portion of driving during said final stage of use, FIG. 7*c* showing the electrical ground rod fully driven into the earth at the completion of said final stage of use, and FIG. 7*d* showing said apparatus removed and said electrical ground rod fully emplaced.

Referring lastly to FIG. 7, illustrating the final stage of use of the present invention, the extension element 12 is positioned over the upper end of the electrical ground rod 10 such that the open end 34 of the tubular segment 33 is vertically aligned with the upper end of the electrical ground rod 10, the solid segment 30 of the extension element 12 extending substantially vertically upwardly therefrom, as shown in FIG. 7*a*. The apparatus 11 is repositioned, as in FIG. 6*d*, so that the end 24 of the second tubular element 16 is vertically over the upper end 31 of the solid segment 30 of the extension element 12, also as shown by FIG. 7*a*. The tubular segment 33 of the extension element 12 is then engaged upon the upper end of the electrical ground rod 10, the end 24 of the second tubular element 16 of the apparatus 11 is engaged upon the upper end 31 of the solid segment 30 of the extension element 12, and the elements are lowered, in a direction indicated by an arrow 47, to assume the relative positions shown in FIG. 7*b*, wherein the lower end 32 of the solid segment 30 of the extension element 12 rests upon, and in contact with, the upper end of the electrical ground rod 10 enclosed within the cavity, and the plug 23 within the second tubular element 16 of the apparatus 11 rests upon, and in contact with, the upper end 31 of the solid segment 30 of the extension element 12. It is to be again noted that the end 24 of the second tubular element 16 is not in contact with the tubular segment 33 of the extension element 12.

As in the previous stages of use of the present invention, the user grasps the third tubular element 17 as a handle and performs repeated raising and forceful lowering, in the respective directions indicated by the arrows 37 and 38, of the apparatus 11 relative to the extension element 12 so as to cause the plug 23 to impact upon the upper end 31 of the solid segment 30 of the extension element 12, which communicates a downward driving force onto the upper end of the electrical ground rod 10 from the lower end 32 of the solid segment 30. This procedure is continued until the interface between the lower end 32 of the solid segment 30 of the extension element 12 and the tubular segment 33 of the extension element 12 is substantially coplanar with the local earth surface. It is to be noted that the tubular segment 33 of the extension element 12 becomes driven into the earth surface during this stage of use, as is shown by FIG. 7*c*. Upon reaching this position, the electrical ground rod 10 has become fully driven vertically into the earth along its entire extent. The apparatus 11 and the extension element 12 are then disengaged from each other and from the upper end of the electrical ground rod 10, leaving a fully emplaced electrical ground rod, as shown in FIG. 7*d*.

While the foregoing has described, in detail, a preferred embodiment of the present invention and the manner of its use, these descriptions have also suggested a plurality of alternate embodiments having differing physical dimensions from those set forth in the above. It is emphasized that, except for such constraints as may be set forth herein, all such variations in dimensions are contemplated to be within the scope of the present invention. It is further contemplated that placement of the impacting surfaces may be further varied, and that the assembly of the three tubular elements 14, 16, and 17 to form the apparatus 11 may assume a configuration other than that of the equilateral triangle of the preferred embodiment. These, and all other alternate embodiments and modifications that may become obvious or reasonable from the foregoing descriptions, are within the contemplation of the herein invention, which is to be limited in scope solely by the claims appended hereto.

I claim:

1. Apparatus for manually driving an electrical ground rod, said electrical ground rod typically having a circular cross section of an accepted standard diameter and a length of approximately 305 centimeters said apparatus comprising:

a first tubular element, formed of a length of a rigid, durable, right circular cylindrical annular stock having an inner cylindrical diameter and an outer cylindrical diameter, said inner cylindrical diameter being adapted to freely receive said electrical ground rod axially therethrough, said length being defined by a first end thereof and a second end thereof, both said first end and said second end being formed to be substantially orthogonally transverse to a longitudinal axis of said first tubular element, said length being constrained to be approximately thirty centimeters;

a cap element, formed of a segment of a right circular solid cylindrical stock having a diameter substantially equal to the outer diameter of said first tubular element, said cap element being formed from a high tensile strength material, with a longitudinally directed thickness sufficient to withstand repeated longitudinally directed impacts upon an upper end of said electrical ground rod; said cap element being rigidly coaxially affixed to said first end of said first tubular element so as to fully close said first end;

a second tubular element, fabricated as a rigid coaxial assembly of a first tubular segment and a second tubular segment separated by, and rigidly affixed to a plug element, said first tubular segment and said second tubular segment each being substantially physically and dimensionally equal to said first tubular element, and said plug element being substantially physically and dimensionally equal to said cap element, said second tubular element having a first open end thereof and a second open end thereof; said second tubular element having an assembled overall length constrained to be approximately sixty centimeters plus the axial thickness of said plug element;

a third tubular element, fabricated as a further length of right circular cylindrical annular stock substantially physically and dimensionally equivalent to the stock used to fabricate said first tubular element, except as to length, said third tubular element having a first end thereof and a second end thereof separated by a length sufficient to enable a user to reasonably hold said third tubular element vertically upwardly such that said first end thereof is at an elevation of at least three and one-half meters above a surface supporting a standing user;

said first tubular element, said second tubular element, and said third tubular element being assembled into a rigid and durable unit wherein longitudinal axes of said first, second and third tubular elements are arranged to be mutually parallel, and wherein a planar surface of said cap element obverse to that affixed to said first end of said first tubular element, said first end of said second tubular element, and said first end of said third tubular element are substantially coplanar, with respective second ends of said first, second, and third tubular elements being respectively separated from said plane in a mutually common direction; and an extension element, formed as a coaxially aligned rigid assembly comprised of a length of right circular cylindrical solid stock, of substantially the same cross-sectional dimensions as said electrical ground rod, having a first end thereof and a second end thereof, said length being constrained to exceed the inner axial length of a segment of said second tubular element, extending from a first end of said second tubular element to said plug element, by approximately two centimeters, and a segment of tubular stock, a first end of which is rigidly attached to said second end of said length of solid cylindrical stock, said tubular segment having substantially the same physical and cross-sectional dimensional properties as said first, second, and third tubular elements, said tubular segment having an internal axial length sufficient to axially slidably engage upon an upper end of said electrical ground rod but not exceeding fifteen centimeters.

2. An apparatus for driving an electrical ground rod as claimed in claim 1, wherein said third tubular element has a length between one hundred fifty two centimeters and one hundred eighty three centimeters.

3. An apparatus for driving an electrical ground rod as claimed in claim 1, wherein said third tubular element has a length of approximately one hundred fifty two centimeters.

4. An apparatus for driving an electrical ground rod as claimed in claim 1, wherein said rigid and durable assembled arrangement of said first, second, and third tubular elements is such that said respective longitudinal axes of said first, second, and third tubular elements intersect an imaginary plane extending mutually orthogonal thereto at vertices of an imaginary equilateral triangle having side lengths substantially equal to the outer diameter of the tubular stock from which said first, second, and third tubular elements are fabricated.

5. Apparatus for manually driving an electrical ground rod, said electrical ground rod typically having a circular cross section of an accepted standard diameter and a length of approximately 305 centimeters, said apparatus comprising:

a first tubular element, formed of a length of a rigid, durable, right circular cylindrical annular stock having an inner cylindrical diameter and an outer cylindrical diameter, said inner cylindrical diameter being adapted to freely receive said electrical ground rod axially therethrough, said length being defined by a first end thereof and a second end thereof, both said first end and said second end being formed to be substantially orthogonally transverse to a longitudinal axis of said first tubular element, said length being constrained to be approximately thirty centimeters, a cap element, formed of a segment of a right circular solid cylindrical stock having a diameter substantially equal to the outer diameter of said first tubular element, said cap element being formed from a high tensile strength material, with a longitudinally directed thickness sufficient to withstand repeated longitudinally directed impacts upon an upper end of said electrical ground rod; said cap element being rigidly coaxially affixed to said first end of said first tubular element so as to fully close said first end;

a second tubular element, fabricated as a rigid coaxial assembly of a first tubular segment and a second tubular segment separated by, and rigidly affixed to a plug element, said first tubular segment and said second tubular segment each being substantially physically and dimensionally equal to said first tubular element, and said plug element being substantially physically and dimensionally equal to said cap element, said second tubular element having a first open end thereof and a second open end thereof; said second tubular element having an assembled overall length constrained to be approximately sixty centimeters plus the axial thickness of said plug element;

a third element, fabricated as a further length of a right circular cylindrical solid stock having an outer cylindrical diameter substantially equivalent to the outer diameter of the tubular stock used to fabricate said first tubular element, said third element having a first end thereof and a second end thereof separated by a length sufficient to enable a user to reasonably hold said third element vertically upwardly such that said first end thereof is at an elevation of at least three and one-half meters above a surface supporting a standing user;

said first tubular element, said second tubular element, and said third element being assembled into a rigid and durable unit wherein longitudinal axes of said first and second tubular elements and said third element are arranged to be mutually parallel, and wherein a planar surface of said cap element obverse to that affixed to said first end of said first tubular element, said first end of said second tubular element, and said first end of said third element are substantially coplanar, with respective second ends of said first and second tubular elements and said third element being respectively separated from said plane in a mutually common direction; and an extension element, formed as a coaxially aligned rigid assembly comprised of a length of right circular cylindrical solid stock, of substantially the same cross-sectional dimensions as said electrical ground rod, having a first end thereof and a second end thereof, said length being constrained to exceed the inner axial length of a segment of said second tubular element, extending from a first end of said second tubular element to said plug element, by approximately two centimeters, and a segment of tubular stock, a first end of which is rigidly attached to said second end of said length of solid cylindrical stock, said tubular segment having substantially the same physical and cross-sectional dimensional properties as said first and second tubular elements, said tubular segment having an internal axial length sufficient to axially slidably engage upon an upper end of said electrical ground rod but not exceeding fifteen centimeters.

6. An apparatus for driving an electrical ground rod as claimed in claim 5, wherein said third element has a length between one hundred fifty two centimeters and one hundred eighty three centimeters.

7. An apparatus for driving an electrical ground rod as claimed in claim 5, wherein said third element has a length of approximately one hundred fifty two centimeters.

8. An apparatus for driving an electrical ground rod as claimed in claim 5, wherein said rigid and durable assembled arrangement of said first and second tubular elements and said third element is such that said respective longitudinal axes of said first and second tubular elements and said third element intersect an imaginary plane extending mutually orthogonal thereto at vertices of an imaginary equilateral triangle having side lengths substantially equal to the outer diameter of the stock from which said first and second tubular elements and said third element are fabricated.

* * * * *